US010189485B2

(12) United States Patent
Gibney et al.

(10) Patent No.: US 10,189,485 B2
(45) Date of Patent: Jan. 29, 2019

(54) EQUIPMENT ENVELOPE FOR HOPPER WAGON

(71) Applicant: Drax Power Limited, Selby, North Yorkshire (GB)

(72) Inventors: Richard Peter Gibney, Derby (GB); David Thomas Turner, Derby (GB); Paul Hodgkinson, Derby (GB)

(73) Assignee: Drax Power Limited, Selby, Yorkshire (GB)

( * ) Notice: Subject to any disclaimer, the term of this patent is extended or adjusted under 35 U.S.C. 154(b) by 55 days.

(21) Appl. No.: 14/768,612

(22) PCT Filed: Feb. 18, 2014

(86) PCT No.: PCT/GB2014/050469
§ 371 (c)(1),
(2) Date: Aug. 18, 2015

(87) PCT Pub. No.: WO2014/128448
PCT Pub. Date: Aug. 28, 2014

(65) Prior Publication Data

US 2016/0001787 A1 Jan. 7, 2016

(30) Foreign Application Priority Data

Feb. 19, 2013 (GB) ..... 1302875.8

(51) Int. Cl.
*B61D 7/00* (2006.01)
*B61D 7/02* (2006.01)
*B61D 17/00* (2006.01)

(52) U.S. Cl.
CPC ..... *B61D 7/00* (2013.01); *B61D 7/02* (2013.01); *B61D 17/00* (2013.01)

(58) Field of Classification Search
CPC ... B61D 7/00; B61D 7/02; B61D 7/06; B61D 7/08; B61D 7/14; B61D 7/16; B61D 7/24; B61D 7/32
See application file for complete search history.

(56) References Cited

U.S. PATENT DOCUMENTS 4,280,596 A 7/1981 Miller
5,216,958 A 6/1993 Kurtz
6,637,346 B2 * 10/2003 Gaydos ..... B61D 7/20 105/247

FOREIGN PATENT DOCUMENTS

DE 397280 C 6/1924
DE 410193 C 12/1925
(Continued)

OTHER PUBLICATIONS

International Search Report dated Jul. 4, 2014 in connection with related International Patent App. No. PCT/GB2014/050469, 3 pages.
(Continued)

*Primary Examiner* — Robert J McCarry, Jr.
(74) *Attorney, Agent, or Firm* — Gesmer Updegrove LLP

(57) ABSTRACT

The present invention relates to an equipment envelope (10) for a hopper wagon. The equipment envelope comprises a housing (11) that is configured to define an enclosed cavity storage space (12) in a bulk commodities storage chamber of a hopper wagon body, in which hopper wagon control means and/or other component parts of the hopper wagon (30) can be housed for use. The equipment envelope may be configured to be arranged in the chamber such that it is located above a hopper wagon bogie (40), preferably adjacent a closable outlet. The equipment envelope may comprise a first end wall (111) that is configured to extend at a predetermined incline angle α towards the outlet. Depending on the configuration of the hopper wagon, the equipment housing may be configured to be located adjacent a further or
(Continued)

alternative closable outlet. The equipment envelope may comprise a second end wall (112) that is configured to extend at a predetermined incline angle β towards the further outlet. The first end wall and second end may be configured to meet at an apex (14) such that the equipment envelope has a cross-sectional profile of a triangle, preferably a scalene triangle. A further aspect of the present invention relates to a hopper wagon comprising at least one equipment envelope.

14 Claims, 6 Drawing Sheets

(56) References Cited

FOREIGN PATENT DOCUMENTS

| | | | |
|---|---|---|---|
| GB | 10787 | A | 9/1915 |
| WO | 2014128448 | A1 | 8/2014 |

OTHER PUBLICATIONS

International Preliminary Report on Patentability dated Aug. 25, 2015 in connection with related International Patent App. No. PCT/GB2014/050469, 4 pages.

* cited by examiner

EQUIPMENT ENVELOPE FOR HOPPER WAGON

PRIORITY INFORMATION

The present invention is a claims priority to PCT Application No. PCT/GB2014/050469 filed Feb. 18, 2014, that claims priority to British Application No. 1302875.8, filed on Feb. 19, 2013, both of which are incorporated herein by reference in their entireties.

FIELD OF INVENTION

The present invention relates to hopper wagons and the siting of hopper wagon control means in hopper wagons. The present invention is particularly concerned with an equipment envelope for housing hopper wagon control means within a bulk commodities storage chamber of a hopper wagon body.

BACKGROUND TO THE INVENTION

A conventional hopper wagon comprises a hopper wagon body with a storage chamber for storing bulk commodities, an inlet formed in the top of the body through which the bulk commodities are loaded into the storage chamber, at least one closable outlet formed in the base of the body through which the bulk commodities are discharged under the force of gravity from the storage chamber, an underframe for supporting the body, a first bogie and a second bogie coupled to the underside of the underframe and control means for controlling the operation of the hopper wagon.

To optimise the capacity of the storage chamber and discharging of the bulk commodities, it is customary for the bogies to be arranged adjacent to each headstock and for the control means of the hopper wagon to be arranged externally to the storage chamber. The control means may be arranged on the outer surface of the storage chamber, in external recesses and/or on the underframe. For example, in the conventional hopper wagon shown in FIG. 1, hopper wagon control means (1) are arranged externally to the storage chamber of the hopper wagon body (2) in a recess (3) formed at the end of a hopper wagon body between an inclined end wall of the storage chamber (4) and the underframe (5). The bogies (6) of the conventional hopper wagon are arranged adjacent the respective headstocks (7) such that the at least one closable outlet (8) is arranged centrally and discharges bulk commodities between the bogies.

SUMMARY OF THE INVENTION

The present invention seeks to provide an alternative and improved solution for siting the control means of a hopper wagon. Embodiments of the present invention seek to provide a siting solution for the control means and/or other component parts that does not compromise the storage capacity of the bulk commodities storage chamber. Indeed, certain embodiments of the present invention seek to provide a siting solution for the control means and/or other component parts that allows for the storage capacity of the bulk commodities storage chamber to be improved. Embodiments of the present invention seek to provide a siting solution for the control means and/or other component parts that does not compromise the flow of the bulk commodities into or out of the storage chamber of the hopper wagon body. In fact, certain embodiments of the present invention seek to provide a siting solution for the control means and/or other component parts that aids the flow of the bulk commodities during the discharging process.

The present invention is defined in the attached independent claims, to which reference should now be made. Further preferred features may be found in the subclaims appended thereto.

A first aspect of the invention relates to an equipment envelope for housing hopper wagon control means and/or other component parts in a bulk commodities storage chamber of a hopper wagon body.

The equipment envelope comprises a housing structure that is configured to be incorporated within the chamber so as to define an enclosed cavity storage space in the chamber, in which hopper wagon control means and/or other component parts can be positioned for use.

The equipment envelope is configured to envelop or encase hopper wagon control means and/or other component parts within the chamber of the hopper wagon body. As a result, the hopper wagon control means and/or other component parts are advantageously concealed by the equipment envelope from bulk commodities stored in the chamber of the hopper wagon body.

The equipment envelope may house the control means closer to the hopper wagon features being controlled. Hence, the construction of the control means may be simplified and/or the operation of the control means may be improved.

The equipment envelope is preferably positioned within the chamber of the hopper wagon body at a location directly above a hopper wagon bogie which, in turn, is arranged on the underside of a hopper wagon underframe. Accordingly, the equipment envelope does not extend across any closable outlets, hindering the discharging process.

The equipment envelope may be integrally formed with the hopper wagon. For example, the housing of the equipment envelope may be configured as part of the base of the hopper wagon body, preferably overhead the bogie. Alternatively, the housing of the equipment envelope may be configured to be mounted in the chamber of the hopper wagon body.

The housing of the equipment envelop may be configured to be supported by the hopper wagon underframe, preferably above the bogie.

The housing of the equipment envelope may comprise at least a first end wall, a second end wall, a first side wall and a second sidewall.

The first end wall may be inclined at a first incline angle with respect to the horizontal plane.

The second end wall may be inclined at a second incline angle with respect to the horizontal plane.

The first end wall and second end wall may be configured to meet at an apex. The first end wall and second end wall may meet at an apex such that the equipment envelope has a cross-sectional profile of a triangle. For example, an embodiment of the equipment envelope may comprise a first end wall, second end wall, first sidewall and second sidewall, whereby the first end wall is inclined at the first incline angle and the second end wall is inclined at the second incline angle, which is different to the first incline angle, and the first wall and second wall are configured to meet at an apex such that the equipment envelope has a prism shape with cross-sectional profile of a scalene triangle.

The equipment envelope may be arranged adjacent a first closable outlet formed in the base of the hopper wagon body and optionally arranged adjacent a second closable outlet formed in the base of the hopper wagon body To help guide bulk commodities towards the first outlet, the first end wall may be configured to be inclined at the first incline angle towards the first outlet.

To help guide bulk commodities towards the second outlet, the second end wall may be configured to be inclined at the second incline angle towards the second outlet.

To further improve the discharging process, the first incline angle of the first end wall and/or the second incline angle of the second end wall may be selected according to the flow characteristics of the bulk commodities so as to aid the flow of bulk commodities towards the respective outlets formed in the base of the hopper wagon body.

To help reduce the degree of stress suffered by the equipment envelope, the first incline angle and length of the first end wall and/or the second incline angle and length of the second end wall may be selected according to the maximum possible stress loads applied by the bulk commodities on the first end wall and second end wall so as to optimise the surface areas of the first end wall and/or second end wall and thereby improve the dissipation of the stress loads acting on the housing. For example, the first incline angle, length of the first end wall, second incline angle and length of the second end wall may be selected such that the surface area ratio of the end walls generally corresponds to the stress loads ratio of the stress loads acting on end walls. As a consequence, the degree of stress suffered by the equipment envelope will be more uniform across the equipment envelope. If the hopper wagon is configured such that the bulk commodities are expected to apply different stress loads on the end walls of the equipment envelope then the equipment envelope may have an offset shape.

The equipment envelope may be configured to be interconnected to a bogie to allow for the transfer of stress loads to a floor supporting the hopper wagon. In an embodiment, the equipment envelope may be interconnected to the bogie via a bolster and/or the hopper wagon underframe.

The equipment envelope may be configured to extend across the width of the chamber of the hopper wagon body between opposing hopper wagon body sidewalls. Hence, the first sidewall of the equipment envelope may be formed from a portion of a first sidewall of the hopper wagon body and the second sidewall of the equipment envelope may be formed from a portion of a second sidewall of the hopper wagon body.

The equipment envelope may comprise one or more apertures formed in the housing to allow access to the control means and/or other component parts mounted in the enclosed cavity storage space. The apertures are advantageously configured to allow user access without compromising the enclosure of the control means and/or other component parts in the hopper wagon body.

The equipment envelope may be configured to support a bulkhead wall so as to improve the structural integrity of the hopper wagon body and optionally divide the storage chamber of the hopper wagon body into storage regions.

A second aspect of the invention relates to a hopper wagon comprising: a hopper wagon body comprising a storage chamber for storing bulk commodities, an inlet through which bulk commodities can be loaded into the chamber and at least one closable outlet through which bulk commodities can be discharged from the chamber, an underframe for supporting the hopper wagon body, a first bogie and a second bogie coupled to the underside of the underframe, control means for controlling the operation of the hopper wagon and at least one equipment envelope according to the first aspect of the invention for housing control means in the chamber.

A first end wall and a second end wall of the chamber are preferably configured to extend respectively in a substantially upright direction from a first headstock region and second headstock region of the underframe. Due to the equipment envelope, the conventional external storage recesses formed between the inclined end walls of the chamber and the underframe are no longer necessary. Hence, the chamber of the hopper wagon body may be reconfigured such that the end walls extend in a substantially upright direction from the headstock regions of the underframe and the chamber thereby extends at least substantially the length of the hopper wagon body. As a result, any loss in bulk commodity storage capacity due to the equipment envelopment is offset by the increase in volume gained by using upright end walls. Indeed, the volume gained by reconfiguring the end walls may be so significant that the overall volumetric capacity of the storage chamber increases.

The first bogie and the second bogie may be arranged a predetermined distance from the first headstock region and second headstock region respectively. Given that the equipment envelopment is arranged directly above the bogie, the spacing of the bogies from the headstocks may improve the storage capacity.

Due to the spaced arrangement of the first bogie from the first headstock, the hopper wagon body may comprise a closable outlet configured to allow for the discharge of bulk commodities from the chamber between the first headstock and the first bogie. Due to the spaced arrangement between the first bogie and the second bogie, the hopper wagon may comprise one or more closable outlets configured to allow for the discharge of bulk commodities from the chamber between the first bogie and the second bogie. Due to the spaced arrangement of the second bogie from the second headstock, the hopper wagon may further comprise a closable outlet configured to allow for the discharge of bulk commodities from storage chamber between the second headstock and the second bogie. Hence, the spacing of the bogies from the headstocks allows for the arrangement of closable outlets along the length of the hopper wagon body and thereby improves the discharge of bulk commodities.

The hopper wagon may comprise an equipment envelope according the first aspect of the invention incorporated within the chamber of the hopper wagon body at a location above each hopper wagon bogie.

An embodiment of the hopper wagon comprises a bulk commodities storage chamber at least substantially extending the length of the hopper wagon body having a first storage region, second storage region, third storage region and fourth storage region; a first closable outlet arranged in association with the first storage region, between the first headstock and the first bogie, a second closable outlet arranged in association with the second storage region, between the first bogie and the second bogie, a third closable outlet arranged in association with the third storage region, between the first bogie and the second bogie, a fourth closable outlet arranged in association with the fourth storage region, between the second bogie and the second headstock, a first equipment envelope incorporated in the first storage region and second storage region at a location above the first bogie adjacent the first outlet and second outlet and a second equipment envelope incorporated in the third storage region and fourth storage region at a location above the second bogie adjacent the third outlet and the fourth outlet.

BRIEF DESCRIPTION OF DRAWINGS

For a better understanding of the present invention and to show how it may be carried into effect, reference shall now be made by way of example to the accompanying drawings in which.

DETAILED DESCRIPTION OF THE INVENTION

Figure 1:
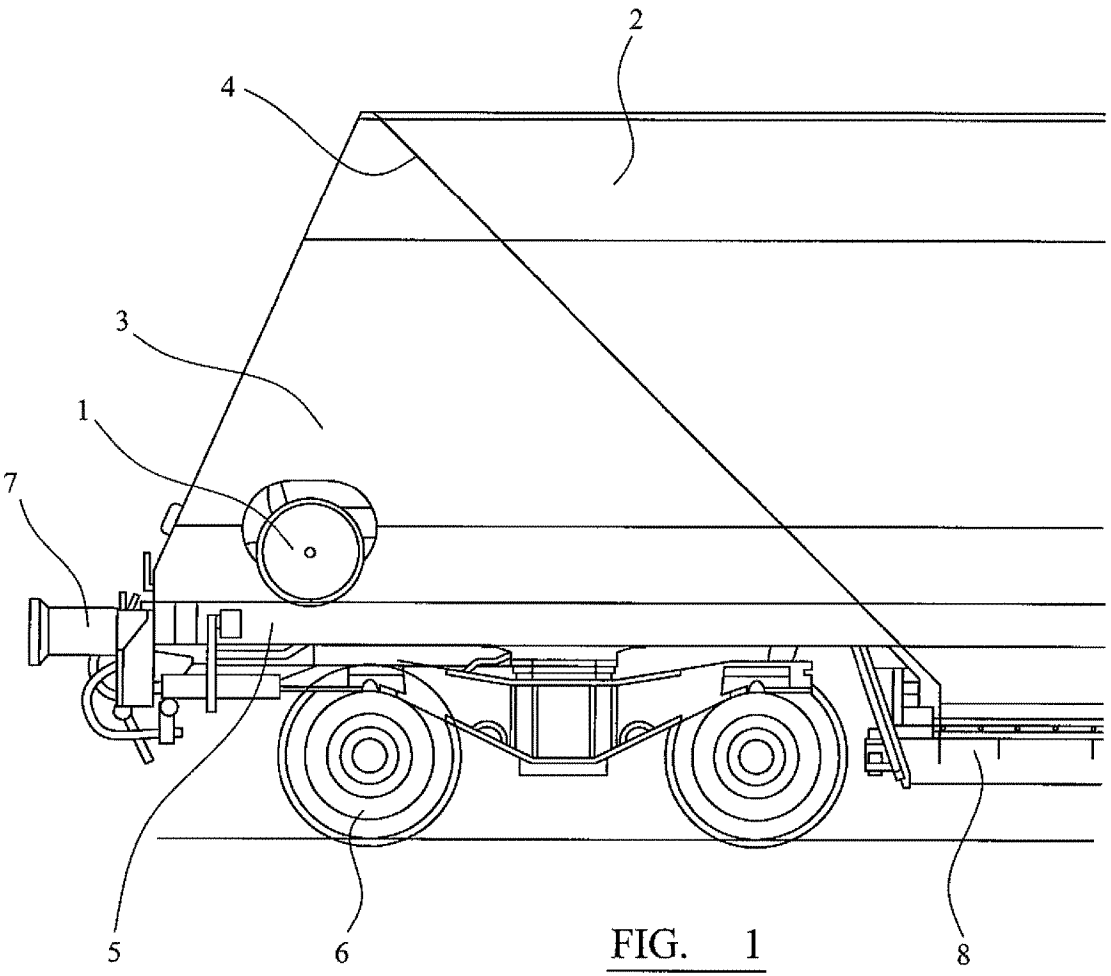
FIG. 1 PRIOR ART
FIG. 1 depicts a side view of an end portion a conventional hopper wagon showing how hopper wagon control means are arranged externally to the storage chamber of a hopper wagon body.
Figure 2:
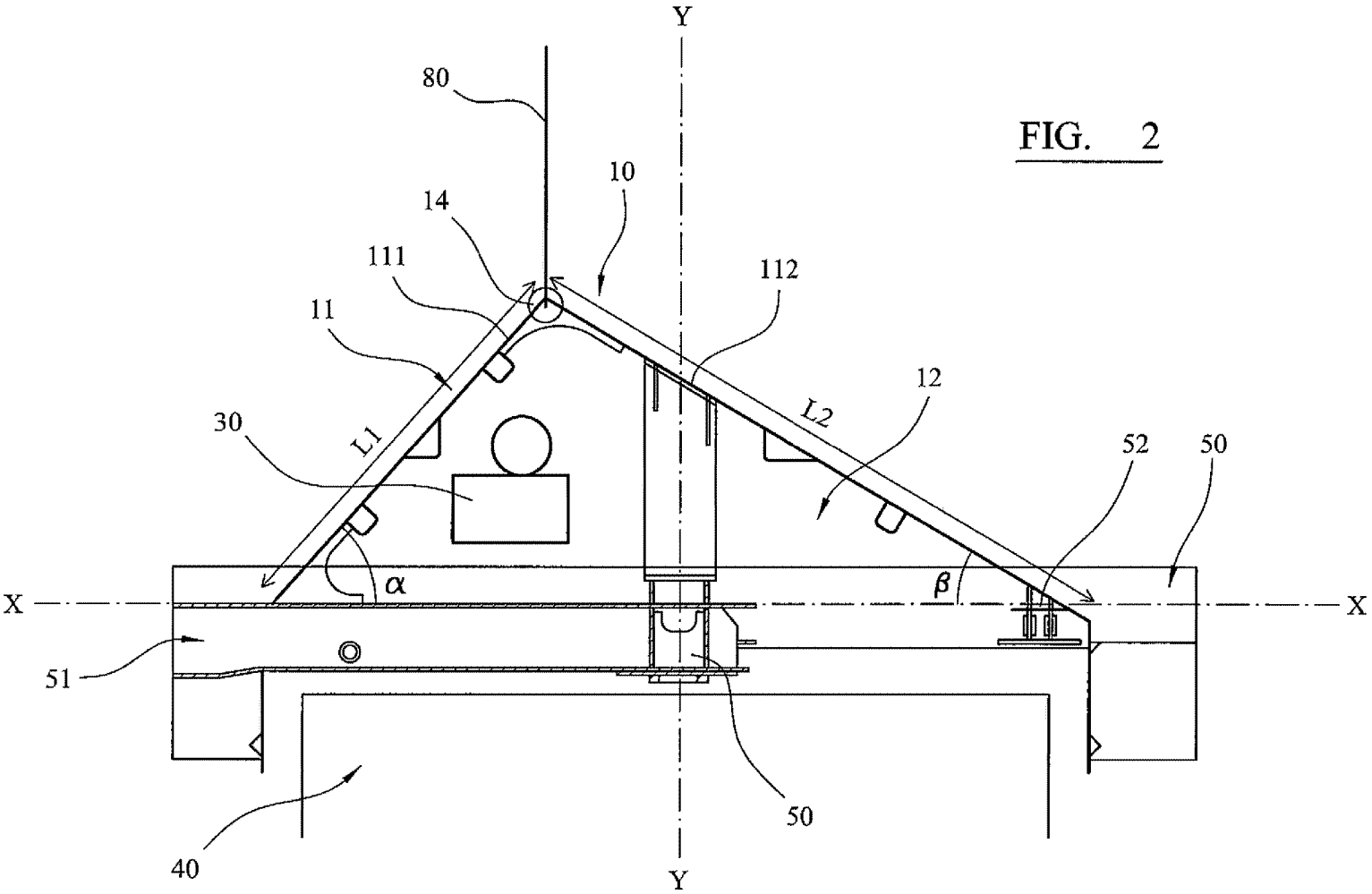
FIG. 2 depicts a cross-sectional view showing an embodiment of an equipment envelope according to the present invention.
Figure 3:
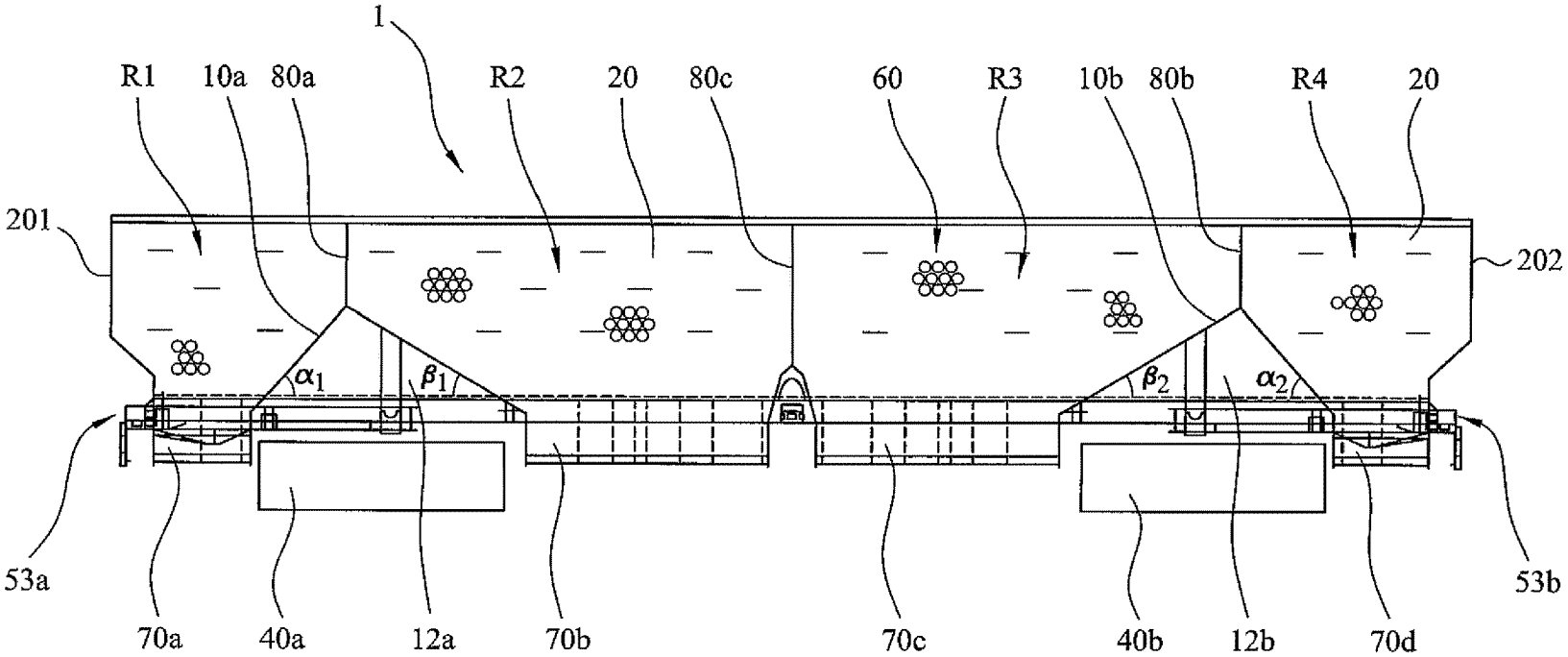
FIG. 3 depicts a cross-sectional view of a hopper wagon comprising a first equipment envelope and a second equipment envelope incorporated in the storage chamber of the hopper wagon body, in accordance with an embodiment of the present invention.
Figure 4:
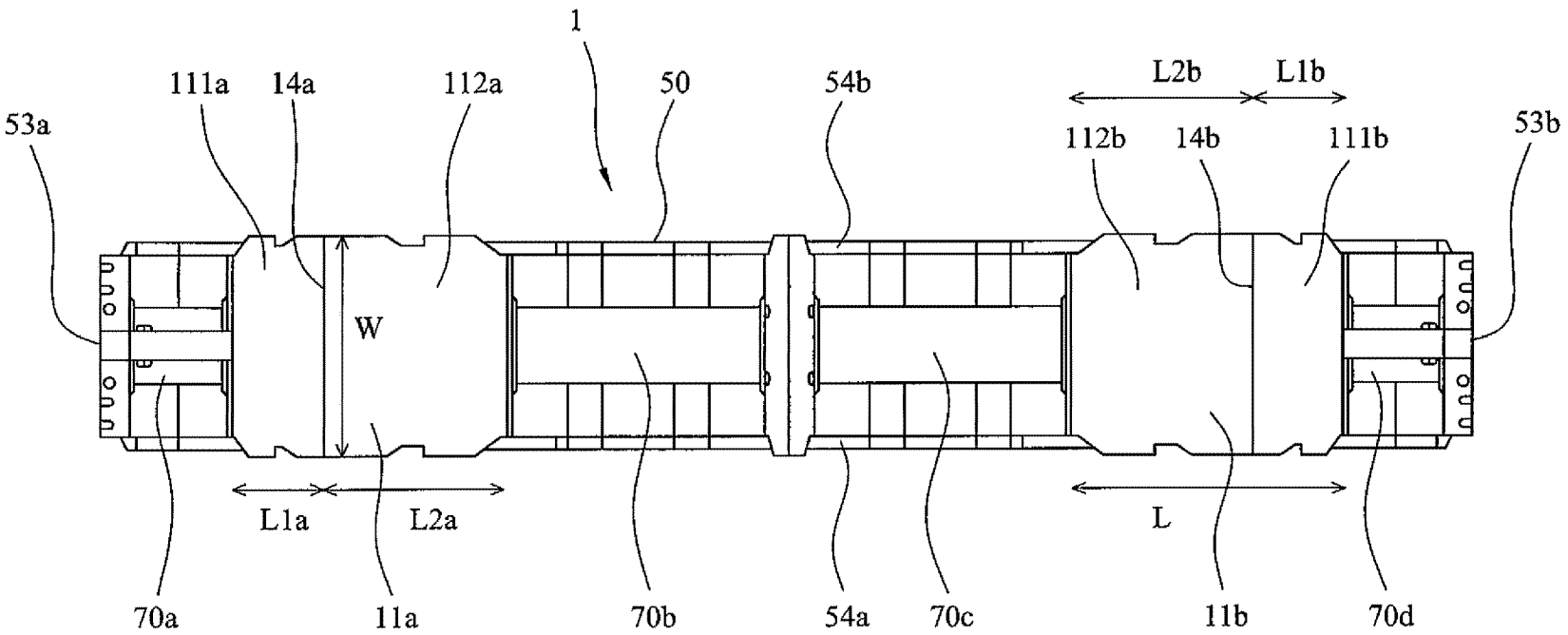
FIG. 4 depicts a top view of the hopper wagon of FIG. 3 showing how the first equipment envelope and second equipment envelope are supported by the hopper wagon underframe.

With reference to the embodiment depicted in FIG. 2, an equipment envelope (10) according to the present invention is essentially an enclosure or containing structure that is configured to house hopper wagon control means and/or other component parts of the hopper wagon within a bulk commodities storage chamber of a hopper wagon body.

The equipment envelope comprises a housing (11) that is configured to define an enclosed cavity storage space (12) within the chamber of the hopper wagon body (20), in which control means and/or other component parts of the hopper wagon (30) can be sited for use.

As shown in FIG. 2, the equipment envelope is configured to be arranged (incorporated) within the chamber at a location directly above (overhead) a hopper wagon bogie (40) which, in turn, is arranged on the underside of a hopper wagon underframe (50).

The housing is configured to enclose or shroud any control means and/or other component parts arranged in the enclosed cavity storage space. As a result, the control means and/or component parts are concealed by the equipment envelope within the chamber. Accordingly, the control means and/or other component parts are separated and protected by the equipment envelope from any bulk commodities (60) stored within the chamber.

The equipment envelope is configured to house any suitable control means in the chamber. For example, the equipment envelope may store bogie brake control means, inlet door control means, outlet door control means, pneumatic pipes, air reservoirs etc. The equipment envelope may also or alternatively be configured to house any suitable component parts of the hopper wagon. For example, the equipment envelope may store vibrating means to vibrate the chamber and thereby encourage the discharge of bulk commodities, reinforcing means to improve the structural integrity of the hopper wagon etc.

The equipment envelope preferably houses the control means closer to features being controlled. Hence, the construction of the control means may be simplified and the operation of the control means may be improved.

The equipment envelope may have any suitable shape and size. For example, the housing of the equipment envelope may be configured to have a prism-like shape with a regular or irregular cross-sectional profile. The housing may have a right angled triangle prism shape, an isosceles triangle prism shape, a scalene triangle prism shape (as shown in FIG. 2), a square prism shape or a rectangular prism shape.

The housing comprises at least a first end wall (111), a second end wall (112), a first sidewall (not shown) and a second sidewall (not shown), whereby the first end wall and second end wall are configured to respectively face the end walls of the chamber and the first sidewall and the second sidewall are configured to respectively face the sidewalls of the chamber. The first end wall has a transverse length L1. The second end wall has a transverse length L2.

The equipment envelope may be integrally formed as part of the hopper wagon. For example, the equipment envelope may be a base portion of the hopper wagon body that is located directly above a bogie as shown in FIG. 2. Alternatively, the housing of the equipment envelope may be pre-formed and mounted in chamber so as to define the enclosed cavity storage space at a position directly above a bogie.

The housing of the equipment envelope may be configured to be supported by the hopper wagon underframe (50), in a position directly above a bogie. For example, the housing may be supported by solebars, cross-members and/or dragbox of the underframe. In the embodiment depicted in FIG. 2, the equipment envelope housing (11) comprises a first end wall (111) and second end wall (112) that are mounted on the underframe such that the equipment envelope is formed directly above a bogie (40). The first end wall (111) is mounted on a cross member (51) of the underframe and the second end wall (112) is mounted on a cross member (52) of the underframe. The first end wall and second end wall are also coupled to the opposing solebars (not shown). The underframe may define a base (bottom) of the housing. The housing may be coupled to the underframe using coupling means and/or a welding process. The coupling means may be nuts, bolts, rivets or any other suitable coupling means. The welding process may incorporate a penetration weld technique. Since the bogie is coupled to the underside of the underframe, the equipment envelope is thereby interconnected to the bogie via the underframe.

The equipment envelope may extend at least substantially across the width of the chamber between the opposing sidewalls of the hopper wagon body. The end walls of the housing may be arranged to abut, forming a sealing engagement with the sidewalls of the storage chamber which, in turn, are formed by the sidewalls of the hopper wagon body. Hence, the first sidewall of the equipment envelope may be formed by a portion of the first sidewall of the hopper wagon body. The second sidewall of the equipment envelope may be formed by a portion of the second sidewall of the hopper wagon body.

The equipment envelope may comprise one or more apertures (13) formed in the housing to allow user access to any control means mounted and/or component parts sited within the enclosed cavity storage space, without compromising the concealment of the control means and/or component parts by the equipment envelope in the hopper wagon body. Depending on the configuration of the equipment envelope, the apertures may be formed in a base and/or a sidewall of the equipment envelope. Indeed, the housing of the equipment envelope may be configured to have a base (underside) that is substantially open so as to allow user access into the equipment envelope via the underframe. The apertures may be closable when user access is not required.

The equipment envelope may be configured to be arranged adjacent a closable outlet (not shown) formed in the base of the hopper wagon body on one side of the bogie.

The first end wall (111) may be inclined at a first incline angle α relative to a horizontal plane (XX). The first end wall (111) of the equipment envelope housing may be configured to extend at an incline angle α towards the (first) closable outlet. The first end wall is inclined at angle α towards the outlet so as to advantageously guide the bulk commodities towards the outlet. Moreover, the first end wall may be inclined at angle α to advantageously aid the flow of the bulk commodities through the first outlet during the discharging process. Hence, the equipment envelope improves the discharging of the bulk commodities through the outlet.

When incorporated in the chamber, the equipment envelope may also or alternatively be configured to be located adjacent a further (second) closable outlet formed in the base of the hopper wagon body on the opposing side of the bogie. For example, if the hopper wagon comprises a pair of closable outlets formed in the base of the hopper wagon body on either side of a bogie, then the equipment envelope may be configured to be arranged in the chamber at a location above the bogie and between the pair of closable outlets.

The second end wall (112) may be inclined at a second incline angle β relative to a horizontal plane (XX). The second end wall (112) of the equipment envelope housing may be configured to extend at an incline angle β towards the further outlet and thereby guide the bulk commodities towards the further outlet. The second end wall is inclined at an angle β relative to the horizontal plane. As with the first end wall, the second end wall is preferably inclined at angle β to aid the flow of the bulk commodities through the further outlet during the discharging process, and thereby improve the discharging process.

The first end wall may be inclined at the same angle as the second end wall, whereby angle α=angle β. Alternatively, as shown in FIG. 2, the first end wall may be inclined at a greater angle than the second end wall, whereby angle α>angle β.

The first end wall and second end wall may be configured to meet at an apex (14). The apex is a junction, corner or bend forming a peak of the housing and it extends at least substantially along the width of the housing. The first end wall and the second end wall of the housing may be coupled together at the apex using coupling means and/or a welding process. The coupling means may comprise nuts, bolt, rivets and/or any other suitable coupling means. The welding process may use a penetration welding technique.

The equipment envelope housing may comprise a first end wall and second end wall that is configured to meet at an apex such that the equipment envelope has a prism-like shape with a cross-sectional profile of a triangle. If the first end wall and second end wall are inclined at different angles of inclination to the horizontal plane XX, then the first end wall and second end wall may be configured to meet at an apex such that the equipment envelope has an offset prism-like shape with a cross-sectional profile of a scalene triangle as shown in FIG. 2.

As explained previously, control means are traditionally stored outside the chamber of the hopper wagon body and bogies are typically coupled to the underframe adjacent the headstocks. However, due to the equipment envelope, the extensive external storage recesses formed between the inclined end walls of the chamber and hopper wagon underframe are no longer necessary. Moreover, given that the inclined end wall(s) of the equipment envelope helps to guide the bulk commodities towards the closable outlet(s), the end walls of the chamber need no longer be inclined towards the closable outlet(s). Hence, the chamber of the hopper wagon body may be reconfigured such that the end walls extend in a substantially upright direction from the headstock regions of the underframe. As a result, any loss in the bulk commodities storage capacity due to the equipment envelopment is compensated by the increase in bulk commodities storage capacity gained by reconfiguring the end walls of the chamber. Indeed, it has been found that the volume gained by reconfiguring the end walls of the chamber may be so significant in comparison to the volume taken by the equipment envelope that the overall bulk commodities storage capacity of the hopper wagon body increases. To aid the discharge of bulk commodities from all parts of the chamber, the bogies are preferably coupled to the underside of the underframe at a predetermined distance from the respective headstocks such that additional outlets can be formed in the base of the hopper wagon body between the headstocks and bogies. Hence, the present invention contradicts the established practice and rational in relation to the arrangement of control means, bogies and outlets.

The equipment envelope may be configured to support a bulkhead wall (80). The bulkhead wall may be configured to extend upwardly from the equipment envelope and between the sidewalls of the hopper wagon body. If the equipment envelope has a cross-sectional profile of a triangle, then the bulkhead may be coupled to the apex of the equipment envelope as shown in FIG. 2. The bulkhead wall improves the structural rigidity of the railway vehicle and it may help to partition the hopper wagon body into regions.

Any bulk commodities stored in the chamber of the hopper wagon body will apply a stress load (for example, a shear stress load) on the equipment envelope. The degree of stress suffered by the equipment envelope will depend on the size of the bulk commodities storage chamber, which in turn will determine the maximum possible volume of bulk commodities stored in the chamber, the type of the bulk commodities stored in the chamber and the surface area of the housing on which the stress load acts. Hence, the surface area of the housing of the equipment envelope is preferably configured to reduce the degree of stress and/or dissipate the stress more uniformly across the housing, such that the structural integrity of the equipment envelope is maintained.

Incline angle α and length L1 of the first end wall and/or incline angle β and length L2 of the second end wall are preferably selected to optimise and regulate the surface areas of the first end wall and second end wall in accordance with the stress loads acting on the first end wall and the second end wall. For example, if the hopper wagon body is configured such that the stress load acting on the first end wall is smaller than the stress load acting on the second end wall, then the housing of the equipment envelope is preferably configured to have an offset shape whereby the surface area ratio of the end walls preferably corresponds to the load ratio acting on the end walls. As a result, the stress suffered of the equipment envelope is reduced and more uniformly dissipated across the equipment envelope. As shown in FIG. 2, this may be achieved by carefully selecting the inclined angle α and length L1 of the first end wall and the angle β and length L2 of the second end wall to ensure the ends walls of the housing have appropriate surface areas to dissipate the different stress loads applied by the bulk commodities. Accordingly, the equipment envelope has a cross-sectional profile of a scalene triangle whereby the central vertical axis YY of the first bogie extends through the second end wall.

To allow for the transfer of the stress loads to a floor that supports the hopper wagon, the equipment envelope is configured to be interconnected with the bogie. For example, the equipment envelope and bogie are coupled via the underframe. The equipment envelope and bogie may also be interconnected by using a bolster (90) that extends between the bogie and the housing. Due to the overhead arrangement and interconnection of the equipment envelope with respect to the bogie, the transfer of the stress loads from the equipment envelope to the floor, via the bogie, is enhanced.

Due to the offset shape of the equipment envelope, the usable portion of the cavity storage space defined by the equipment envelope is optimised. Also, the offset shape improves the fit (placement, positioning) of the housing with respect to other component parts of the hopper wagon, for example, the actuating means of the closable outlets of the hopper wagon.

It will be understood that the dimensions of the equipment envelope depend on the type and dimensions of the hopper wagon, the loading gauge of the railway track along which the hopper wagon travels and type of bulk commodities being transported by the hopper wagon.

The inclined angle $\alpha$ of the first end wall and/or the inclined angle $\beta$ of the second end wall may be selected from a range of approximately 10° to 75° depending on the type of bulk commodities being transported by the hopper wagon, the flow characteristics of the bulk commodities, the volume of the bulk commodities, shear loads of the bulk commodities acting on the housing and size of the outlets. For example, the inclined angle $\alpha$ and/or inclined angle $\beta$ may fall within a range of approximately 20° to 45°, preferably 30° for biomass and fall within a range of approximately 45° to 70°, preferably 60° for coal.

The length of the first end wall (L1) may range from approximately 1.5 m to 3 m. The length of the second end wall (L2) may range from approximately 1.5 m to 3 m. The maximum length of the equipment envelope (L), extending from the first end wall to the second end wall, may range from approximately 1.5 m to 3 m. The maximum height (H) of the equipment envelope may range from approximately 1 m to 2 m.

The equipment envelope may be formed from a metal or any other material that has sufficient structural integrity. For example, the equipment envelope housing may be formed from sheet stainless steel.

With reference to the embodiment depicted in FIGS. 3 to 5*b*, a hopper wagon according to the present invention may comprise one or more equipment envelopes to house control means and/or component parts of the hopper wagon in the chamber of the hopper wagon body.

The hopper wagon may comprise multiple equipment envelopes whereby each equipment envelope has a different design. Alternatively, as depicted in FIGS. 3 to 5*b*, the hopper wagon may comprise multiple equipment envelopes having substantially the same design.

FIGS. 3 to 5*b* depict views of an embodiment of a hopper wagon for transporting biomass.

The hopper wagon (1) comprises a hopper wagon body with a storage chamber (20) having four storage regions (R1, R2, R3, R4) for storing biomass, an inlet through which biomass can be loaded into the chamber, four closable outlets (70*a*, 70*b*, 70*c*, 70*d*) through which bulk commodities can be discharged from the respective the storage regions; an underframe (50) for supporting the hopper wagon body; a first bogie (40*a*) and a second bogie (40*b*) coupled to the underside of the underframe; control means (30) for controlling the operation of the hopper wagon; a first equipment envelope (10*a*) and a second equipment envelope (10*b*).

To optimise the biomass storage capacity of the hopper wagon, the first end wall of the chamber (201) is configured to extend generally upwardly from the first headstock region of the underframe (53*a*). Likewise, the second end wall of the chamber (202) is configured to extend generally upwardly from the second headstock region of the underframe (53*b*). The sidewalls (203, 204) of the chamber are defined by the sidewalls of the hopper wagon body which extend generally upwardly from the solebars (54*a*, 54*b*) of the underframe.

To further optimise the biomass storage capacity of the hopper wagon and discharging of biomass, the first bogie is coupled to the underframe a predetermined distance from the first headstock region. The second bogie is coupled to the underframe a predetermined distance from the second headstock region.

Each equipment envelope comprises a housing (11*a*, 11*b*) that is configured to define an enclosed cavity storage space (12*a*, 12*b*) in which control means and/or other component parts of the hopper wagon can be mounted for use.

The first equipment envelope is configured within the chamber (20) at a location directly above the first bogie (40*a*) and adjacent the first closable outlet (70*a*) and the second closable outlet (70*b*). The second equipment envelope is configured within the chamber at a location directly above the second bogie (40*b*) and adjacent a third closable outlet (70*c*) and a fourth closable outlet (70*d*).

Both the first equipment envelope and second equipment envelope have the same offset prism-like shape with a cross-sectional profile of a scalene triangle.

The housing of the first equipment envelope comprises a first end wall 111*a*, a second end wall (112*a*), a first sidewall (113*a*) and a second sidewall (not shown). The first end wall and second end wall are joined at an apex 14*a*. The first end wall (111*a*) extends at an inclined angle $\alpha$1 of approximately 50° from the apex to a peripheral edge of the first outlet (70*a*) with length L1*a* of approximately 1.7 m. The second end wall (112*a*) extends at an inclined angle $\beta$1 of approximately 30° from the apex to a peripheral edge of the second outlet (70*b*) with length L2*a* of approximately 2.7 m. The first sidewall (113*a*) is formed by a scalene triangular portion of the first sidewall (203) of the hopper wagon body. The second sidewall is formed by a scalene triangular portion of the second sidewall (204) of the hopper wagon body.

Likewise, the housing of the second equipment envelope comprises a first end wall (111*b*), a second end wall (112*b*), a first sidewall (113*b*) and a second sidewall (not shown). The first end wall and second end wall are joined at an apex 14*b*. The first end wall (111*b*) extends at an inclined angle $\alpha$2 of approximately 50° from the apex to a peripheral edge of the fourth outlet (70*d*) with length L1*b* of approximately 1.7 m. The second end wall (112*b*) extends at an inclined angle $\beta$2 of approximately 30° from the apex to a peripheral edge of the third outlet (70*c*) with length L2*b* of approximately 2.7 m. The first sidewall (113*b*) is formed by a scalene triangular portion of the portion of first sidewall (203) of the hopper wagon body. The second sidewall is formed by a scalene triangular portion of the second sidewall (204) of the hopper wagon body.

The inclined angles of the end walls of the equipment envelopes are selected in accordance with the flow characteristics of biomass so as to improve the flow of biomass towards the outlets during the discharging process.

Figure 5A:
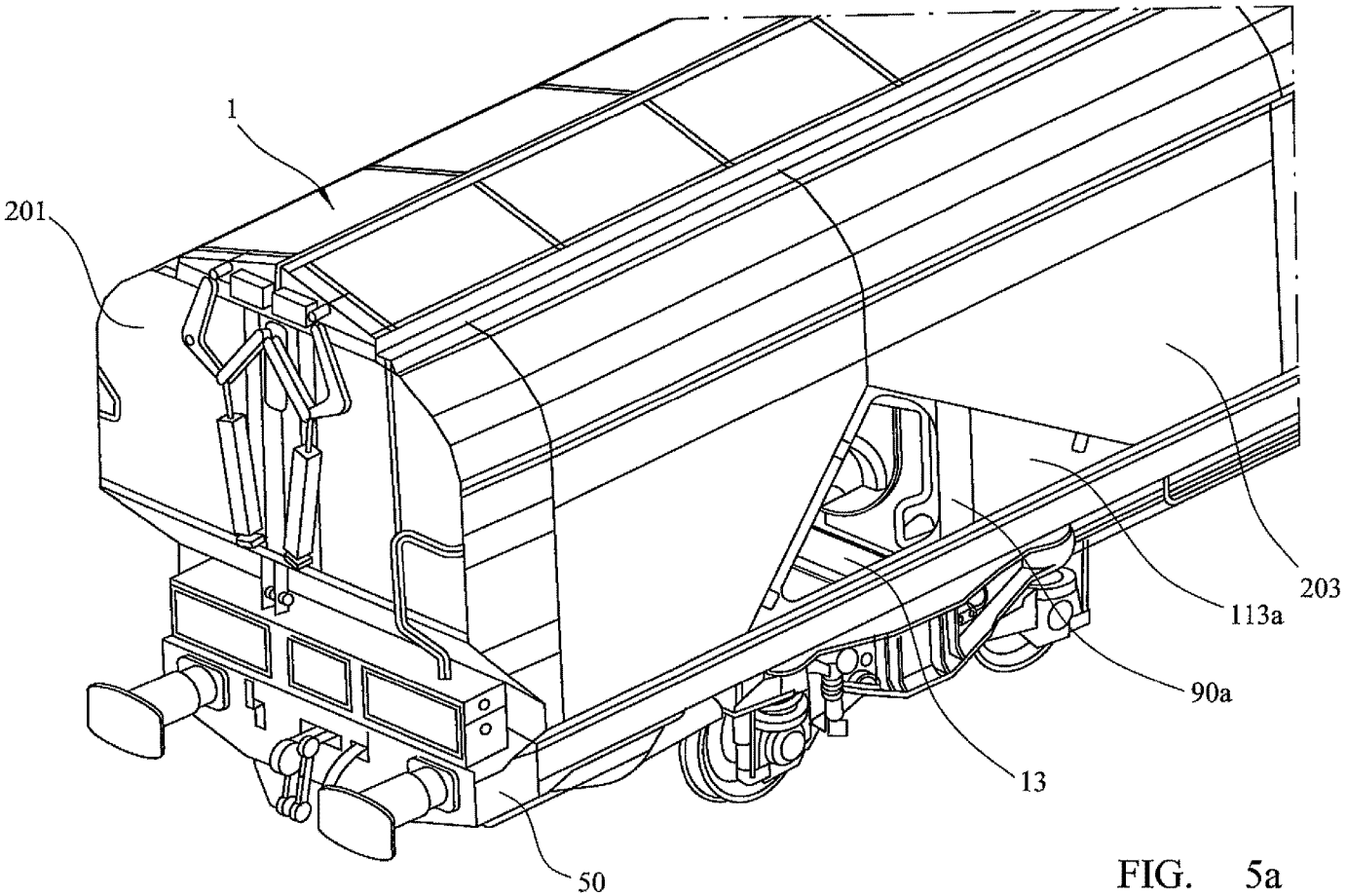
FIGS. 5*a* and 5*b* depict views of the hopper wagon of FIG. 3 showing how apertures formed in the sidewall of the hopper wagon body provide manual access to hopper wagon control means housed in the first equipment envelope and the second equipment envelope respectively.
Figure 5B:
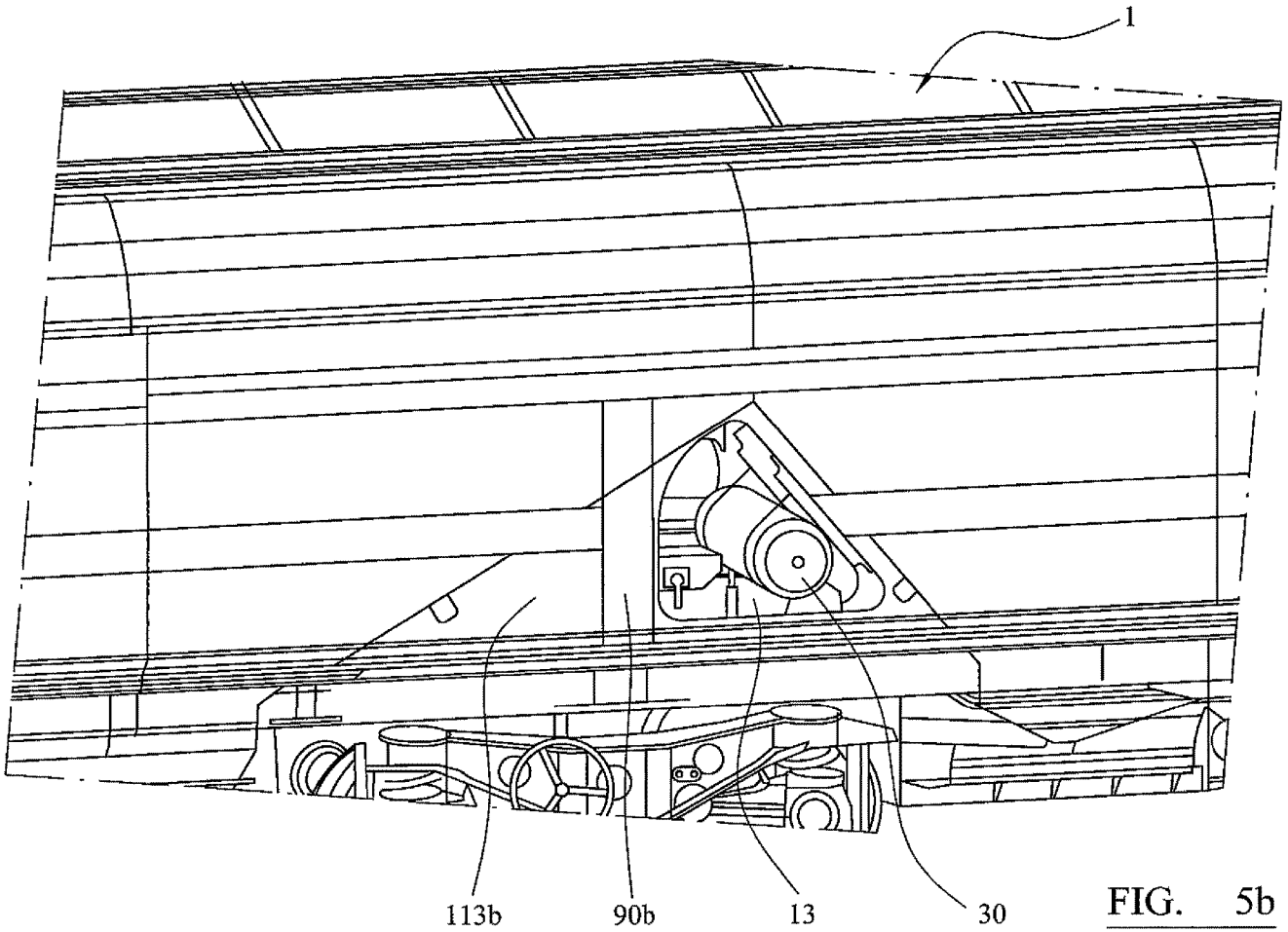

As can be seen in FIGS. 5*a* and 5*b*, apertures (13) are formed in the sidewalls of the equipment envelopes to allow user access to the control means (30) mounted in the enclosed cavity storage spaces. The apertures allow user access into the enclosed cavity storage space without compromising the enclosing effect of the equipment envelope within the chamber of the hopper wagon body. Moreover, the undersides of each equipment envelope are open allowing user access via the underframe.

A first bulkhead (80*a*) wall is mounted on the apex (14*a*) of the first equipment envelope to provide structural integrity and divide the chamber. A second bulkhead wall (80*b*) is mounted on the apex (14*b*) of the second equipment envelope to provide structural integrity and divide the chamber. A central bulkhead wall (80*c*) is mounted at a central position in the hopper wagon body to provide structural integrity and divide the chamber.

The chamber is divided into four biomass storage regions (R1, R2, R3, R4) by the bulkheads. The first region R1 is defined by the first end wall of the hopper wagon body (201), first bulkhead (80*a*) and first inclined end wall of the first equipment envelope (111*a*). The second region (R2) is defined by the first bulkhead (80*a*), the second inclined wall of the first equipment envelope (112*a*) and the central bulkhead (80*c*). The third region (R3) is defined by the central bulkhead (80*c*), the second bulkhead (80*b*) and the second inclined wall of the second equipment envelope (112*b*). The fourth region (R4) is defined by the second bulkhead (80*b*), the first inclined wall of the second equipment envelope (111*b*) and the second end wall of the hopper wagon body (202).

The hopper wagon comprises four closable outlets (70*a*, 70*b*, 70*c*, 70*d*) to discharge the biomass from the respective storage regions. The first closable outlet (70*a*) is arranged in the base of the hopper wagon body in association with the first region (R1) such that bulk commodities are discharged between the first headstock and first bogie of the hopper wagon body. The second closable outlet (70*b*) is arranged in the base of the hopper wagon body in association with the second region (R2) such that the bulk commodities are discharged between the first bogie and the central bulkhead. The third closable outlet (70*c*) is arranged in the base of the hopper wagon body in association with the third region (R3) such that bulk commodities are discharged between the central bulkhead and second bogie. The fourth closable outlet (70*d*) is arranged in the base of the hopper wagon body in association with the fourth region (R4) such that bulk commodities are discharged between the second bogie and the second headstock.

Given that the bogies are arranged closer to the ends of the hopper wagon than the centre of the hopper wagon, the first region has a smaller biomass storage capacity than the second region. Likewise the fourth region has a smaller biomass storage capacity than the third region. The biomass storage capacities of the first region and fourth region are substantially the same. The biomass storage capacities of the second region and third region are substantially the same. In this embodiment, the first region and fourth region each have a volumetric capacity of approximately 18 $m^3$. The second region and third region each have a volumetric capacity of approximately 40 $m^3$.

When the hopper wagon is loaded with biomass, the biomass will apply stress loads on the end walls of the equipment envelopes located in each region. Given that the first region has a lower biomass storage capacity than the second region, the biomass will apply different stress loads on the first end wall and second end wall of the first equipment envelope. Likewise, the biomass will apply different stress loads on the first end wall and the second end wall of the second equipment envelope. Accordingly, the offset shaped equipment envelopes are configured within the storage chamber such that the central vertical axis of the respective bogies extends through the second end walls. As a result, the smaller stress loads act on the shorter first end walls (with smaller surface area) and the large stress loads act on the longer second end walls (with the larger surface area) of the respective equipment envelopes. Hence, the degree of stress suffered by the equipment envelopes is reduced and the structural integrity of the equipment envelopes is maintained. To help transfer the stress loads to the floor supporting the hopper wagon, the housing of the equipment envelopes is interconnected to the bogies via a bolster (90*a*, 90*b*).

Due to the offset configuration of equipment envelopes, the usable the cavity storage space defined equipment envelopes is also optimised and the operation of closable outlets is not impeded.

Whilst endeavouring in the foregoing specification to draw attention to those features of the invention believed to be of particular importance, it should be understood that the applicant claims protection in respect of any patentable feature or combination of features referred to therein, and/or shown in the drawings, whether or not particular emphasis has been placed thereon.

Throughout the description and claims of this specification, the words "comprise" and "contain", and any variations of the words, means "including but not limited to" and is not intended to (and does not) exclude other features, elements, components, integers or steps.

Throughout the description and claims of this specification, the singular encompasses the plural unless the context requires otherwise. In particular, where the indefinite article is used, the specification is to be understood as contemplating plurality as well as singularity, unless the context requires otherwise.

Features, integers or characteristics described in conjunction with a particular aspect, embodiment or example of the invention are to be understood to be applicable to any other aspect, embodiment or example described herein unless incompatible therewith.

The invention claimed is:

1. An equipment envelope for a hopper wagon, the equipment envelope comprising a housing comprising a first end wall, a second end wall, a first sidewall, and a second side wall, incorporated in a bulk commodities storage chamber of the wagon and defining a substantially enclosed cavity storage space in the chamber in which hopper wagon control means and/or other component parts can be accommodated, wherein the equipment envelope is arranged in the chamber at a location above a hopper wagon bogie, wherein the equipment envelope is configured to be arranged in the chamber of the hopper wagon body between a first closable outlet and a second closable outlet, and wherein the first end wall is configured to extend at a first incline angle towards the first closable outlet and the second end wall is configured to extend at a second inclined angle towards the second closable outlet.

2. The equipment envelope according to claim 1, wherein the first end wall and the second end wall are configured to meet at an apex, and optionally the equipment envelope has a cross-sectional profile of a triangle.

3. The equipment envelope according to claim 1, wherein the first incline angle is selected in accordance with the flow characteristics of the bulk commodities.

4. The equipment envelope according to claim 1, wherein the second incline angle is selected in accordance with the flow characteristics of the bulk commodities.

5. The equipment envelope according to claim 4, wherein the first incline angle of the first end wall, length of the first end wall, the second incline angle of the second end wall and length of the second end wall are selected in accordance with the maximum possible stress loads the bulk commodities may apply on the first end wall and second end wall.

6. The equipment envelope according to claim 1, further comprising at least one aperture formed in a base, the first sidewall and/or the second sidewall of the housing to allow user access to hopper wagon control means and/or other component parts sited in the equipment envelope.

7. The equipment envelope according to claim 1, wherein the housing is configured to be mounted on a hopper wagon underframe.

8. The equipment envelope according to claim 1, wherein the equipment envelope is configured to extend at least substantially across a width of the hopper wagon body between a first hopper wagon sidewall and a second hopper sidewall, and optionally the first sidewall of the housing is formed by a portion of the first hopper wagon body sidewall and the second sidewall of the housing is formed by a portion of the second hopper wagon body sidewall.

9. The equipment envelope according to claim 1, wherein the equipment envelope is configured to support a bulkhead wall.

10. The equipment envelope according to claim 1, wherein the equipment envelope is configured to be interconnected with the bogie to allow for the transfer of stress loads from the equipment envelope to a floor supporting the hopper wagon.

11. A hopper wagon comprising an equipment envelope incorporated in a bulk commodities storage chamber, whereby the equipment envelope comprises a housing comprising a first end wall, a second end wall, a first sidewall, and a second side wall, that is configured to define a substantially enclosed cavity storage space in the chamber, in which hopper wagon control means and/or other component parts can be sited for use, wherein the equipment envelope is arranged in the chamber at a location above a hopper wagon bogie, wherein the equipment envelope is configured to be arranged in the chamber of the hopper wagon body between a first closable outlet and a second closable outlet, and wherein the first end wall is configured to extend at a first include angle towards the first closable outlet and the second end wall is configured to extend at a second incline angle towards the second closable outlet.

12. A hopper wagon comprising:

a bulk commodities storage chamber;

multiple bogies arranged on the underside of the bulk commodities storage chamber;

at least one equipment envelope whereby the or each equipment envelope is incorporated in the chamber at a location overhead a respective bogie and comprises a housing comprising a first end wall, a second end wall, a first sidewall, and a second side wall, that is configured to define a substantially enclosed cavity storage space in the chamber, in which hopper wagon control means and/or other component parts can be sited for use, wherein the equipment envelope is arranged in the chamber at a location above a hopper wagon bogie, wherein the equipment envelope is configured to be arranged in the chamber of the hopper wagon body between a first closable outlet and a second closable outlet, and wherein the first end wall is configured to extend at a first include angle towards the first closable outlet and the second end wall is configured to extend at a second incline angle towards the second closable outlet.

13. A hopper wagon according to claim 12, wherein the first end wall of the chamber is configured to extend in a substantially upright direction from a first headstock region of an underframe and/or the second end wall of the chamber is configured to extend in a substantially upright direction from a second headstock region of the underframe.

14. A hopper wagon according to claim 13, wherein the bogies are coupled to the underframe at a predetermined distance from the first headstock region and the second headstock region.

* * * * *